US008087749B2

(12) United States Patent
Goto et al.

(10) Patent No.: US 8,087,749 B2
(45) Date of Patent: Jan. 3, 2012

(54) INK JET RECORDING HEAD, INK JET CARTRIDGE, AND METHOD FOR MANUFACTURING INK JET RECORDING HEAD

(75) Inventors: Akira Goto, Yokohama (JP); Minoru Nozawa, Yokohama (JP); Yoshiyuki Toge, Yokohama (JP); Tadayoshi Inamoto, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 1033 days.

(21) Appl. No.: 11/916,755

(22) PCT Filed: Apr. 23, 2007

(86) PCT No.: PCT/JP2007/059285

§ 371 (c)(1),
(2), (4) Date: Dec. 6, 2007

(87) PCT Pub. No.: WO2007/126098

PCT Pub. Date: Nov. 8, 2007

(65) Prior Publication Data

US 2009/0128602 A1 May 21, 2009

(30) Foreign Application Priority Data

Apr. 24, 2006 (JP) ..... 2006-119648

(51) Int. Cl.
*B41J 2/14* (2006.01)
*B41J 2/04* (2006.01)

(52) U.S. Cl. ..... 347/47; 347/29; 347/40

(58) Field of Classification Search ..... None
See application file for complete search history.

(56) References Cited

U.S. PATENT DOCUMENTS

| | | | | |
|---|---|---|---|---|
| 4,521,787 | A | 6/1985 | Yokota et al. | 346/140 R |
| 4,666,823 | A | 5/1987 | Yokota et al. | 430/320 |
| 5,594,479 | A | 1/1997 | Inoue et al. | 347/45 |
| 5,649,359 | A | 7/1997 | Murakami et al. | |
| 5,774,151 | A | 6/1998 | Sugitani et al. | 347/63 |
| 5,796,415 | A | 8/1998 | Inoue et al. | 347/45 |
| 5,949,454 | A | 9/1999 | Nozawa et al. | 347/45 |
| 6,484,399 | B2 | 11/2002 | Aono et al. | |
| 6,511,156 | B1 | 1/2003 | Kazama et al. | |
| 6,626,521 | B1 | 9/2003 | Nozawa | 347/63 |

(Continued)

FOREIGN PATENT DOCUMENTS

JP 5-084925 4/1993

(Continued)

OTHER PUBLICATIONS

English translation of Notice of Allowance dated May 2, 2011 in corresponding Korean Application No. 10-2008-7025878.

*Primary Examiner* — Jerry Rahll
(74) *Attorney, Agent, or Firm* — Fitzpatrick, Cella, Harper & Scinto

(57) ABSTRACT

An ink jet recording head has an array of ink ejection outlets in an ejection outlet forming surface, to which a protection tape is adhered during transportation. The ejection outlet forming surface has an outside area which is outside of each of opposite ends of the array with respect to a direction of the array, and the outside area has a peel resistance, provided by surface modification, which resistance is higher than in another portion of the ejection outlet forming surface.

10 Claims, 12 Drawing Sheets

U.S. PATENT DOCUMENTS

| | | | | |
|---|---|---|---|---|
| 6,752,492 | B2 | 6/2004 | Hirosawa et al. | 347/87 |
| 2005/0174386 | A1* | 8/2005 | Spivey et al. | 347/47 |
| 2006/0007282 | A1* | 1/2006 | Lee | 347/86 |
| 2006/0268060 | A1* | 11/2006 | Rosa | 347/47 |
| 2007/0076044 | A1* | 4/2007 | Corley et al. | 347/29 |
| 2007/0103501 | A1 | 5/2007 | Hatsui et al. | 347/20 |
| 2007/0139467 | A1 | 6/2007 | Kihara et al. | 347/40 |

FOREIGN PATENT DOCUMENTS

| | | | |
|---|---|---|---|
| JP | 6-071892 | | 3/1994 |
| JP | 9-254394 | | 9/1997 |
| JP | 11-157082 | | 6/1999 |
| JP | 11-348316 | | 12/1999 |
| JP | 2002-355979 | | 12/2002 |
| JP | 2003-266720 | | 9/2003 |
| JP | 2004-148746 | | 5/2004 |
| JP | 2006-212796 | | 8/2006 |
| KR | 1994-0005410 | A | 3/1994 |
| WO | 01/83219 | A1 | 11/2001 |

* cited by examiner

| | SURFACE CONDITIONS | INK OOZING AFTER STICKING | PEEL RESISTANCE (N/m) |
|---|---|---|---|
| IMMEDIATELY AFTER PRODUCTION | NO WETTING NO SOLIDIFICATION | NO | 74 |
| 1 WEEK AFTER USE-UP | WETTING | YES | 35 |
| 3 MONTHS AFTER USE-UP | SOLIDIFICATION | YES | 24 |
| CLEANING 1 WEEK AFTER USE-UP | NO WETTING NO SOLIDIFICATION | NO | 80 |

INK JET RECORDING HEAD, INK JET CARTRIDGE, AND METHOD FOR MANUFACTURING INK JET RECORDING HEAD

TECHNICAL FIELD

The present invention relates to an ink jet recording head to which a protective tape can be pasted to protect the head surface during the shipment of the ink jet recording head or the like occasions. More specifically, the present invention relates to an ink jet recording head characterized in that a part or parts of its surface at which the outward end of each of the ink jetting nozzles opens have been changed in properties to adjust the ink jet recording head in the fastness of the adhesion between the surface at which the outward end of each of the ink jetting nozzles opens, and a protective tape pasted thereto. The present invention also relates to an ink jet cartridge having such an ink jet recording head, and a method for manufacturing such an ink jet recording head.

BACKGROUND ART

In recent years, digital cameras or the like have been substantially increased in resolution. As a result, the use of recording apparatuses capable of recording a high quality photographic image has been steadily increasing, in particular, ink jet recording apparatuses, which record images by jetting ink toward recording medium. There have been known various methods used for causing the ink jet recording head of an ink jet recording apparatus to jet ink droplets. Ink jet recording heads which use heat as the energy for jetting ink can be relatively easily increased in resolution, that is, the number of ink jetting nozzles. In other words, an ink jet recording head can be relatively easily improved in terms of resolution, image quality, and recording speed. In spite of the increase in the desire for high quality recording, the demand for a recording apparatus capable of recording conventional business documents and web pages has not subsided. Rather, demand has been increasing for recording apparatuses which are not only capable of recording an ordinary document at a substantially higher speed and a substantially higher level of quality than an ink jet recording apparatus in accordance with the prior art, but also, a photographic image at a substantially higher speed and at a substantially higher level of quality than an ink jet recording apparatus in accordance with the prior art.

As the means for dealing with the above described desire, various ink jet recording apparatuses have been offered in the market. One type of such ink jet recording apparatuses is characterized in that when an apparatus of this type records an ordinary document, it uses pigment black ink (Bk), that is, the ink which is high in density, and jets relatively large ink droplets, whereas when it records a web page, not only does it uses the pigment black ink (Bk), but also, cyan (C), magenta (M), and yellow (Y) inks. Further, when it records a photographic image, it uses only color inks.

Also in recent years, in order to enable an ink jet recording apparatus to record at a higher level of quality, the size of the ink droplet an apparatus jets has been further reduced. Thus, the size of an ink droplet jetted by a recent ink jet recording apparatus is as small as several pico litres; a nozzle which jets an ink droplet, the size of which is several pico litres, is roughly 10 μm in the diameter of its opening, and is as thin as 10 μm in the thickness of its wall. In order to improve an ink jet recording head, such as the above described one, in the accuracy with which the ink droplet it jets lands on recording medium, the surface of the ink jet recording head, at which the ink jetting nozzles open, is processed to make the surface repel ink (Japanese Laid-open Patent Applications 2002-355979 (Patent Document 3), 2003-266720 (Patent Document 4)). Further, for the purpose of protecting the minute opening of each nozzle of an ink jet recording head while the ink jet recording apparatus is shipped, a protective tape is pasted to the surface of the ink jet recording head, at which each nozzle opens (Japanese Laid-open Patent Applications 5-084925 (Patent Document 1), 11-348316 (Patent Document 2), and 2004-148746 (Patent Document 5)). This protective tape is to be peeled when an ink jet recording head is used for the first time.

A protective tape which is to be pasted to an ink jet recording head is made up primarily of a substrate layer and an adhesive layer. If the adhesive layer is excessively adherent, it is possible for an ink jet recording apparatus to be damaged around the openings of the nozzles when the protective tape is removed. Thus, a protective tape, the adhesive layer of which is relatively weak in adhesiveness, is sometimes used. However, if a protective tape is excessively weak in adhesiveness, it is possible that the protective tape will peel and fall off a recording head when the recording head is clamped to be conveyed or packaged while the recording head is manufactured with the use of an automatic machine. Thus, various structural arrangements which prevent the portion of a recording head, which has a protective tape, from being clamped, have been tried. However, a protective tape sometimes peeled because of the vibrations which were attributable to the conveyance of the recording head, and/or the changes in the ambient pressure attributable to the acceleration or deceleration of the recording head conveyance speed. In other words, a protective tape, the adhesiveness of which is not strong enough to possibly damage an ink jet recording head across the above mentioned areas, sometimes failed to remain satisfactorily adhered to protect the ink jet recording head.

Further, the surface of an ink jet recording head, at which the ink jetting nozzles are open, is entirely coated with an ink repellent, as described above. The presence of this ink repellent on this surface lessened the adhesion between this surface and a protective tape, resulting in the peeling of the protective tape. Even if a protective tape (adhesive layer) does not completely peel away from this surface, ink will leak; for example, even if a part of a protective tape separates from this surface by a gap of only 1 μm, ink will seep out through this gap due to the capillary action of the ink. As ink leaks, it solidifies during the shipment of the ink jet recording head, or the like occasions, causing the ink jet recording head to fail when the ink jet recording head is put to use by a user.

There are various proposals which were made to solve the above described problems. One of them (Japanese Laid-open Patent Application 2006-212796) is to process the adhesive layer of a protective layer to make the adhesive layer non-uniform in adhesiveness, in such a manner that the adhesive layer is weaker in adhesiveness across the areas in the immediate adjacencies of the opening of each nozzle, and stronger across the rest. Thus, not only can this arrangement prevent a protective tape from peeling, but also, it can prevent an ink jet recording head from being damaged across the portion immediately next to the opening of each nozzle.

This arrangement, however, requires the protective tape, which is non-uniform in adhesiveness, to be highly precisely positioned relative to a recording head when it is pasted to the recording head, possibly complicating the process for pasting the protective tape to an ink jet recording head. In addition, if this protective tape fails to be accurately positioned so that the various areas of the protective layer, which are different in adhesiveness, are correctly positioned relative to the surface of an ink jet recording head, which has the nozzle openings, it is possible that the above-described problems will occur.

The time to irradiate specific areas of a protective tape to achieve a desired level of adhesiveness between the specific areas of the protective tape and a recording head may be after the protective tape is pasted to the recording head, after the completion of the recording head. However, this arrangement complicates the manufacturing process and also requires a manufacturing apparatus of a substantial scale.

DISCLOSURE OF THE INVENTION

The present invention was made to solve the problems described above, without using special processes and manufacturing equipment to manufacture an ink jet recording head, and without modifying a protective tape in adhesiveness, and its primary object is to provide an ink jet recording head, which does not suffer from the above described problem.

Another object of the present invention is to provide a method for changing in properties of the surface of a recording head which has nozzle openings, in order to provide an ink jet recording head in which, even through a protective tape which is uniform in adhesiveness is pasted to the surface of the ink jet recording head having nozzle openings, the adhesion (amount of force necessary to peel protective tape) between the protective tape and the surface having nozzle openings is non-uniform across the interface between the protective tape and the surface of the recording head having nozzle opening.

Another object of the present invention is to provide an ink jet recording head, which was changed in surface properties across specific areas of the surface having nozzle openings, in order to achieve such an amount of adhesion between a protective tape and the surface having nozzle openings that allows the protective tape to be easily peeled by a user when it needs to be peeled, and yet, is sufficient to prevent the protective tape from peeling off from the ink jet recording head, without being large enough to damage the nozzle opening portions of the ink jet recording head when the protective tape is peeled.

Another object of the present invention is to provide an ink jet recording cartridge which employs the ink jet recording head described above. Yet another object of the present invention is to provide an ink jet recording manufacturing method capable of manufacturing an ink jet recording head, such as those described above, without requiring additional steps for achieving the objects described above.

An ink jet recording head which can achieve the above described objects is an ink jet recording head to which a protective tape is pasted across its surface having multiple rows of nozzle openings before it is shipped out, and is characterized in that the peel resistance between the protective tape and the surface having the multiple rows of nozzle openings is greater across the lengthwise end portions of the surface having the multiple rows of nozzle openings, that is, the areas in the adjacencies of the ends of rows of nozzle openings, than across the rest of the surface.

An ink jet recording head which can achieve the above described objects is an ink jet recording head to which a protective tape is pasted across its surface having multiple rows of nozzle openings before it is shipped out, and is characterized in that the peel resistance between the protective tape and the surface having the multiple rows of nozzle openings is greater across the lengthwise end portions of the surface having the multiple rows of nozzle openings, that is, the areas in the adjacencies of the ends of rows of nozzle openings, than across the rest of the surface, and also, that the areas which are higher in the peel resistance than the rest are greater in the amount of the oxygen in the surface layer than the rest.

The method for manufacturing an ink jet recording head which can achieve the above described objects is a method for manufacturing an ink jet recording head made up of: a recording head chip having a surface with multiple rows of openings of ink jetting nozzles, and a frame to which the recording head chip is attached, and is characterized in that in the step in which the recording head chip is temporarily fixed to the frame by irradiating energy rays thereupon, the lengthwise end portions of the surface having the multiple rows of nozzle openings, that is, the areas in the adjacencies of the ends of rows of nozzle openings, are irradiated with the same energy rays as the abovementioned ones to make them greater in the amount of the oxygen in the surface layer than the rest.

According to the present invention, the surface of an ink jet recording head, which has nozzle openings, and across which a protective tape is pasted, is irradiated across a specific area with energy rays, such as X-rays, in order to change the area in properties, that is, to increase the area in the oxygen density in the surface layer, relative to the rest of the surface. With this treatment, this area is increased in the fastness of adhesion (peel resistance) between the adhesive layer of the protective tape and the area. Therefore, even a protective tape having an adhesive layer which is relatively weak in adhesiveness can be used to protect an ink jet recording head, just as effectively as a protective tape which is adherent enough not to peel off during the manufacturing or shipment, without being adherent enough to damage the nozzle opening portions of the ink jet recording head when the protective tape is peeled, and yet, can be easily peeled by a user when it needs to be peeled. In other words, it is possible to achieve three objectives which are contradictory, that is, the objective of making the adhesion between a protective tape and the surface of an ink jet recording head, which has nozzle openings, sufficient to protect the recording head during shipment, the objective of preventing the nozzle opening portions of an ink jet recording head from being damaged when the protective tape is peeled before the ink jet recording head is used, and the objective of making it possible for a protective tape to be easily peeled.

Further, according to the present invention, the energy rays used for temporarily fixing a head chip to the frame of an ink jet recording head, in one of the steps in an ink jet recording head manufacturing process, can be used in the same step to irradiate the surface of the ink jet recording head, which has nozzle openings, across a specific area, with the use of the same energy rays, simply by adjusting the energy rays in range. In other words, a special manufacturing step and/or a special manufacturing apparatus for changing the surface properties is not needed.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(General Structure of Ink Jet Recording Apparatus)

Figure 1:
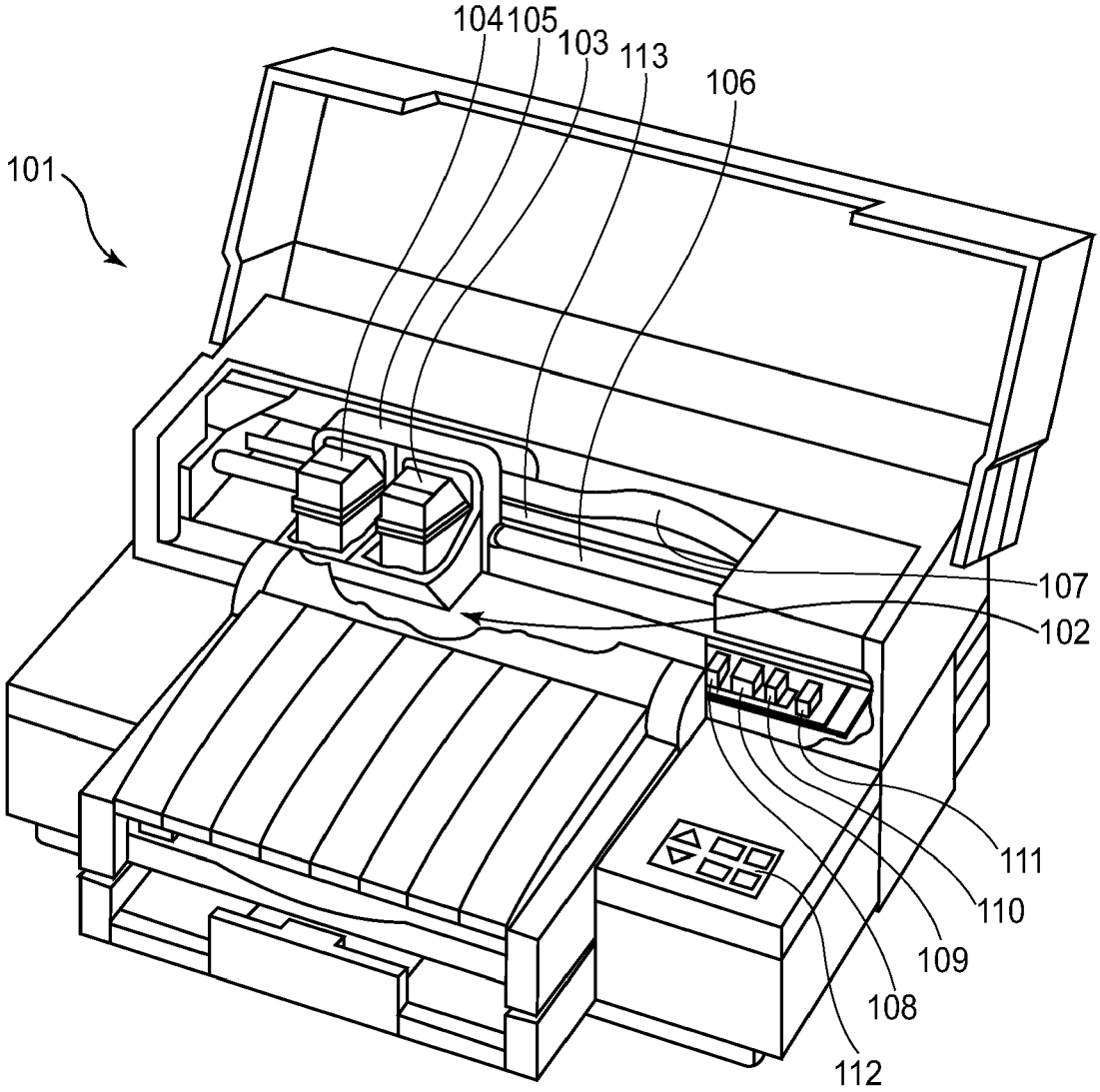
FIG. 1 is a perspective view of a typical ink jet recording apparatus in accordance with the prior art.

FIG. 1 is a perspective view of a typical ink jet recording apparatus, to which the ink jet recording cartridge in the first preferred embodiment of the present invention, is removably mountable. The ink jet recording apparatus 101 is provided with an ink jet recording cartridge 104 for printing in color (which hereafter may be referred to as CI cartridges), and an ink jet recording cartridge 103 for printing in black (Bk) (which hereafter may be referred to as Bk cartridge). The Cl cartridge is provided with three parallel rows of nozzles for jetting cyan (C), magenta (M), and yellow (Y) inks, one for one. The Bk cartridge is provided with a single row of nozzles for jetting black (Bk) ink. Both cartridges are provided with an ink jet recording head capable of jetting ink, and an ink container. The ink jet recording apparatus 101 is made up of: a carriage 105 which holds the two cartridges 104 and 103; a guide shaft 106 for guiding the carriage 105; an encoder film 113 which is read to determine the carriage position in terms of the scanning direction; an unshown carriage motor for moving the carriage 105; a signal transmission cable 107; etc., in addition to the abovementioned ink jet recording head and ink cartridge. The ink jet recording apparatus 101 is also provided with caps 109 and 111, which are disposed next to the home position of the ink jet recording head to maintain the ink jet recording head in terms of ink jetting performance. The ink jet recording apparatus 101 is also provided with cleaning blades 108 and 110 for wiping away the ink on the surface of the ink jet recording head, at which each nozzle opens. It also is provided with a control panel 112.

Figure 2:
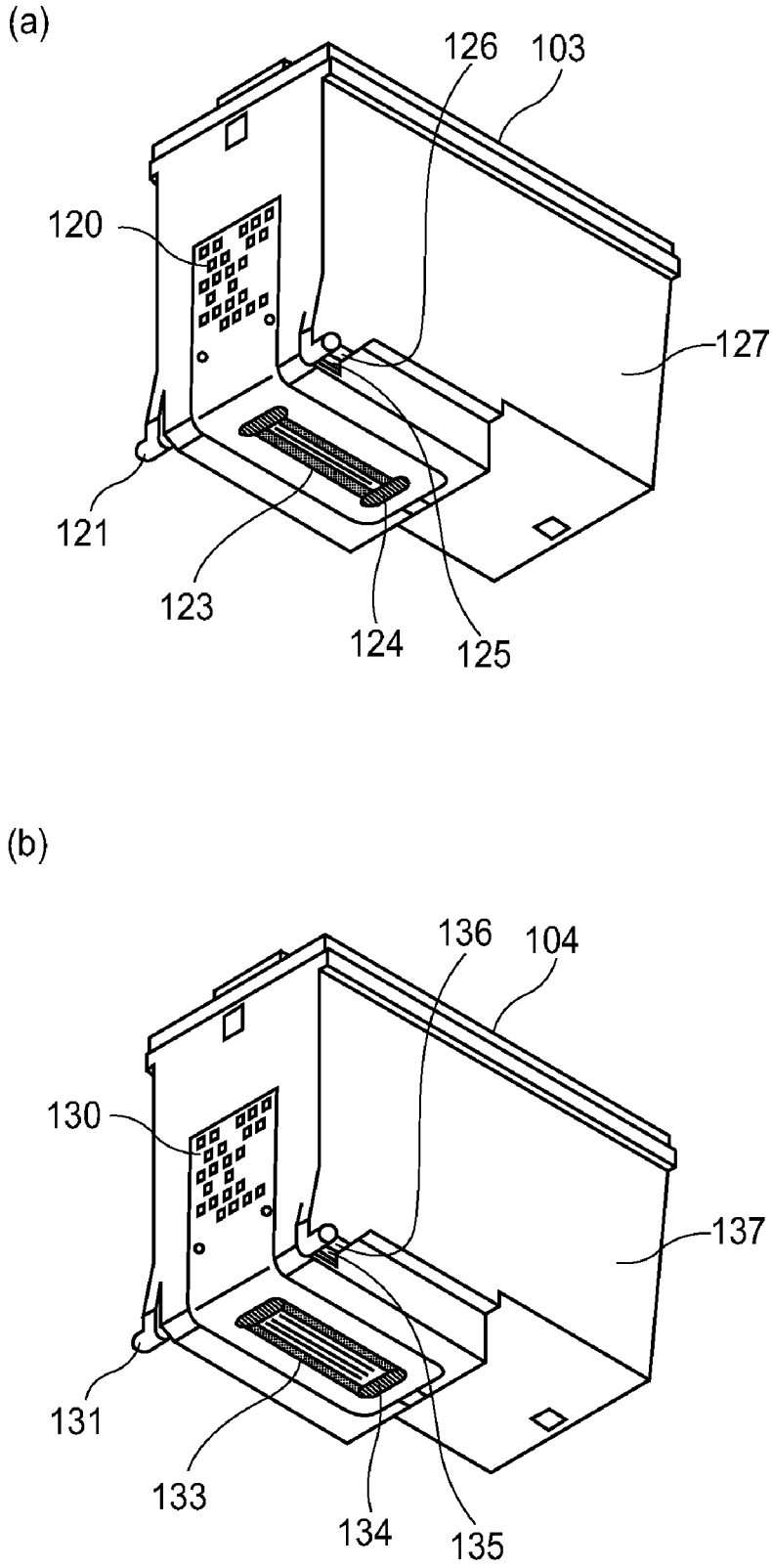
FIG. 2(*a*) is a perspective view of the Bk ink jet cartridge, showing the essential portions thereof, and FIG. 2(*b*) is a perspective view of the Cl ink jet cartridge, showing the essential portions thereof.

FIG. 2(*a*) is a perspective view of the Bk cartridge 103, and shows the essential portions of the Bk cartridge 103. The Bk cartridge 103 is provided with an ink jet recording head 123 and an electric wiring board 120. The ink jet recording head 123 (which hereafter may be referred to as recording element or recording head chip) is in the form of a chip. It jets ink by heating the ink with heat generating resistors. The electric wiring board 120 is for transmitting driving signals or the like from the ink jet recording apparatus 101 to the recording element 123. The recording element of the Bk cartridge 103 is solidly attached to the ink container 127 with the use of an adhesive which is curable with UV light. The Bk cartridge 103 is also provided with a seal portion 124 which protects the electrical joint between the recording element 123 and electric wiring board 120. The ink container 127 is provided with: a pair of guides 121 which are used when the Bk cartridge is mounted on the carriage 103; cartridge position reference surfaces 125 and 126, which are located on one of the lateral sides of the cartridge, in terms of the cartridge insertion direction; and the cartridge position reference surfaces on the other lateral side.

FIG. 2(*b*) is a perspective view of the Cl cartridge 104, and shows the essential portions of the Cl cartridge 104. The Cl cartridge 104 is provided with an ink jet recording head 133, an electric wiring board 130, a seal portion 134, and an ink container 137, which are similar to those of the Bk cartridge. The ink container 137 is provided with: a pair of guides 131; cartridge position reference surfaces 135 and 136, which are located on one of the lateral sides of the Cl cartridge, in terms of the cartridge insertion direction; and the cartridge position reference surfaces on the other lateral side, which also are similar to those of the Bk cartridge.

Figure 3:
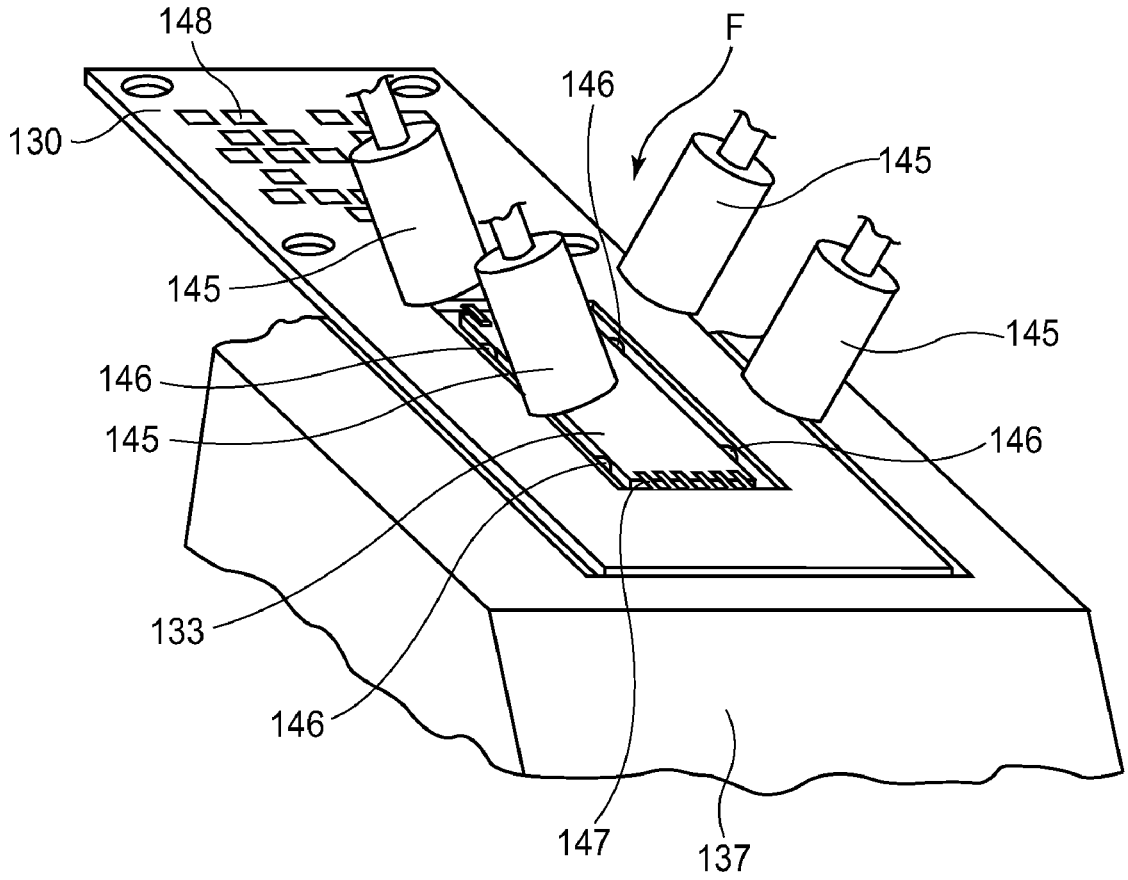
FIG. 3 is a Cl cartridge schematic perspective view of the bottom portion of the Cl cartridge, which shows how a unit F, that is, the combination of the recording element and electrical wiring board, which were electrically connected to each other, is attached to the ink container.

FIG. 3 is a schematic perspective view of the bottom portion of the Cl cartridge, which shows how the aforementioned unit F is attached to a preselected area of the shell (frame) of the ink container 137. The ink container 137 is made up of the shell, and an ink filter (unshown) welded to the inward side of the shell. The unit F is made up of the recording element 133 and electric wiring board 130, which are electrically in connection with each other. Although the Cl cartridge is also provided with a mechanism for immovably retaining the ink container 137, a mechanism for retaining the unit F, an indicator mechanism, etc., these mechanisms are not shown in order to simplify the drawing. Designated by a referential number 146 is a body of adhesive which is curable with UV rays, and keeps the recording element 133 solidly attached to the ink container 137. Optical fibers 145 are for projecting UV rays when hardening the adhesive 146. The electrical wiring board 130 is provided with inner leads 147 and electrical contacts 148, which are for connecting the electrical wiring board 130 to the recording element 133.

Figure 4:
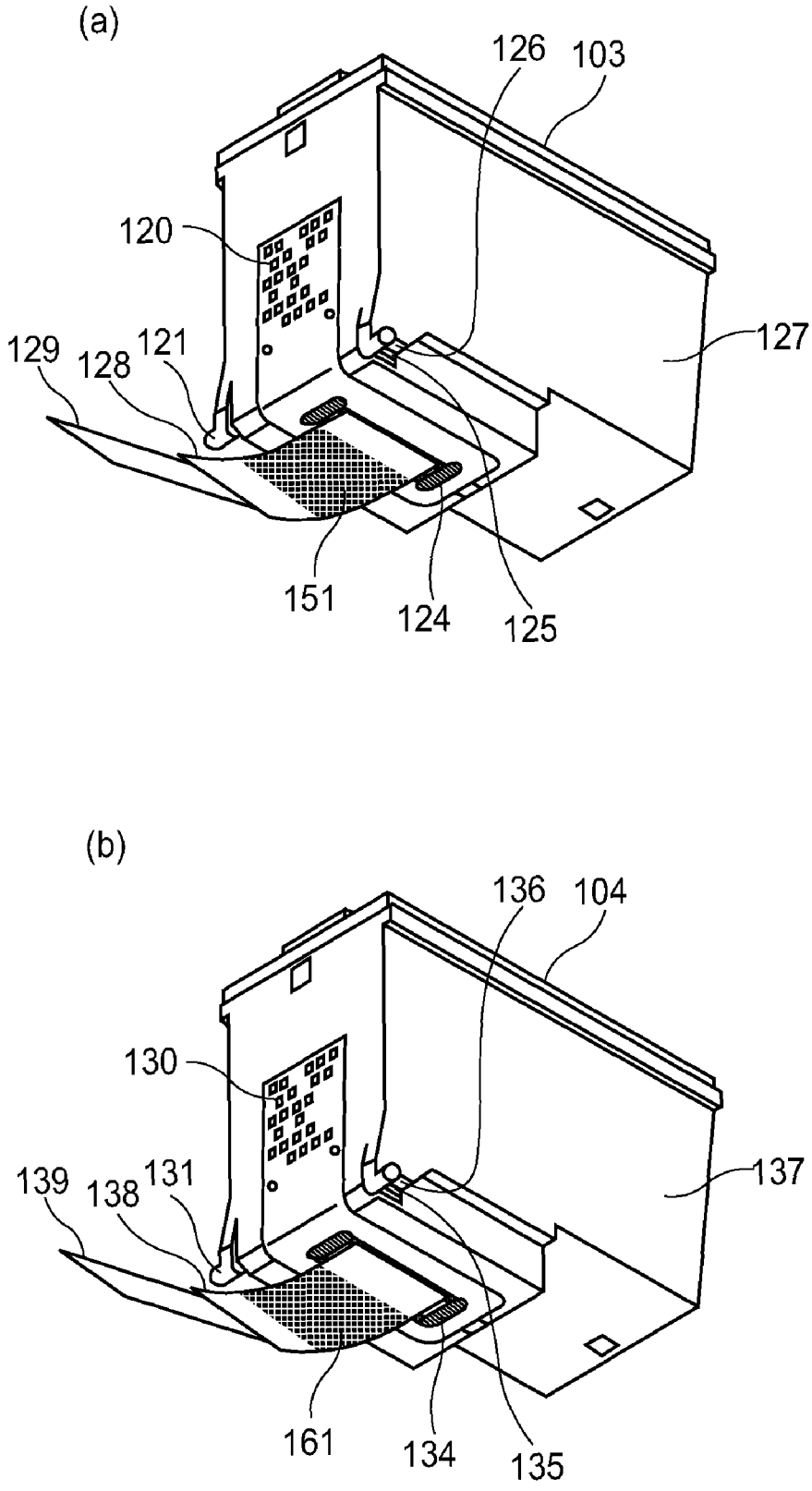
FIG. 4(*a*) is a perspective view of the Bk cartridge having the protective tape, and FIG. 4(*b*) is a perspective view of the Cl cartridge for Cl having the protective tape.

FIGS. 4(*a*) and 4(*b*) show the Bk cartridge 103 and Cl cartridge 104, respectively, which have the protective tape. Designated by referential numbers 129 and 139 in the drawings are tab portions of the protective tapes 128 and 138, respectively, which are to be held by a user when the user intends to peel the protective tapes. These portions 129 and 139 are not provided with the adhesive layer. Further, the protective tapes 128 and 138 are provided with dimpled portions 151 and 161, that is, the portions dimpled to reduce the size of the contact areas between the protective tapes 128 and 138 and the Bk and Cl cartridges 103 and 104, respectively, in order to prevent the protective tapes 128 and 138 from firmly sticking to the electrical wiring boards 120 and 130, ink containers 127 and 137, etc., respectively.

The Bk cartridge 103 and Cl cartridge 104 are roughly the same in structure. Hereafter, therefore, this embodiment will be described with reference to the Bk cartridge 103 alone.

If the ink jet recording apparatus 101 which uses an ink jet recording cartridge, such as the above described Bk cartridge, runs out of the ink in the ink container 127, the entirety of the recording cartridge (Bk cartridge) is replaced with a brand-new one. In other words, a combination of a recording head, and an ink container containing black ink, is sold as the Bk cartridge in the market. In order to sell the Bk cartridge in the market, the Bk cartridge must be distributed to various markets. Thus, the Bk cartridge must be protected from the shocks to which it is subjected during its shipment, and also, the ink in the ink container must be prevented from drying up. In particular, the recording element 123 is very delicate; it is easily damaged, and also, is easily affected in performance by the ink having adhered thereto as it dried up. Thus, the sensitive portions of the Bk cartridge 103 are covered (protected) by the protective tape 128 before the Bk cartridge 103 is distributed.

The protective tape 128 is made up of a substrate layer and an adhesive layer. The substrate layer is formed of polyethylene terephthalate or the like, and the adhesive layer is formed of an acrylic adhesive, or an adhesive of the so-called hot-melt type. The protective tape 128 protects the opening of each nozzle and its adjacencies by being adhered to the surface of the recording element 123 by its adhesive layer in a manner to cover the opening of each nozzle. When a brand-new Bk cartridge 103 is mounted as the replacement for the used Bk cartridge 103 into the ink jet recording apparatus 101, the protective tape 128 on the recording element 123 of the replacement Bk cartridge 103 is to be peeled away by a user.

Figure 5:
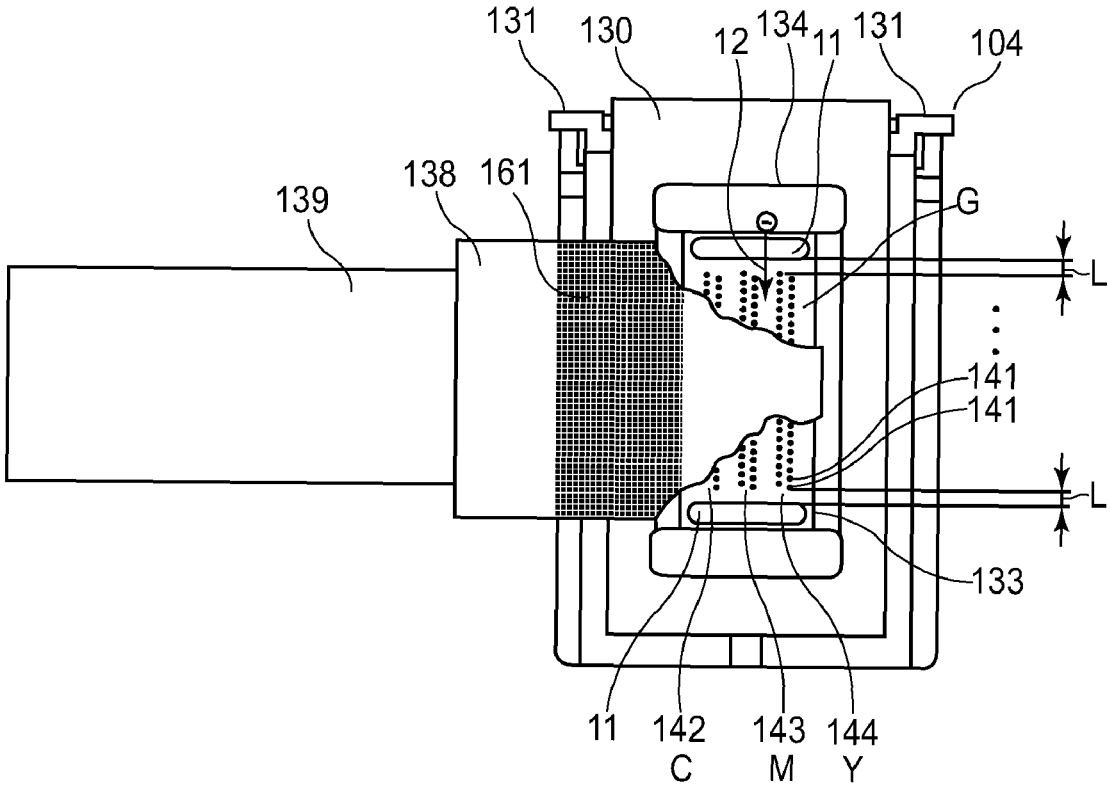
FIG. 5 is a plan view of the ink jet recording cartridge in the first embodiment of the present invention.

FIG. 5 is a schematic plan view of the Cl cartridge 104, from which the protective tape 138 has not been peeled away from its recording element 133. The nozzle openings 141 from which ink droplets are jetted are arranged in six straight lines, that is, two rows of nozzle openings for each primary color (rows 142C, rows 143M, and rows 144Y). The surface G of the recording element 133, which has the nozzle openings 141, is covered with the protective tape 138, which was pasted to the surface G in a manner to cover the entirety of the six straight rows (two rows 142C, two rows 143Y, and two rows 142Y) of nozzle openings 141.

(Distinctive Structural Arrangement)

In order to improve the recording element 133 in reliability, the entirety of the surface G of the recording element 133 has been processed to make the surface G repel ink; the surface G is treated with alkyl-siloxane epoxy resin which contains fluorine. Further, before the protective tape is pasted, the two long and narrow areas 11 (which are located in the outward adjacencies of the ends of the rows 142C, 143M, and 144Y of nozzle openings of the recording element 133, and extend in the width direction of the recording element 133) of the surface G, which constitute parts of the lengthwise end portions of the surface G, are irradiated with UV light, using EXECUR 3000 (product of Hoya Candeo Optronics, Co., Ltd.).

At this time, the changes which occur to the surface of the material for the substrate of the recording element 133 as the material is irradiated with UV light will be described. Ultraviolet rays with a short wavelength are high in photo-energy, being therefore capable of severing molecular bonds, enhancing chemical reactions, etc. Thus, as UV light is projected onto the surface of a given substance, the UV light strikes oxygen molecules, thereby generating thereby ozone. This ozone absorbs the UV rays and/or heat, breaking into active oxygen, and the active oxygen oxidizes or removes the organic substances on the surface of the substance. The UV light, the wavelength of which is a certain range, is greater in energy than the covalent bond energy, being therefore capable of directly severing the covalent bonds within a molecule. Thus, in some cases, using UV rays, the wavelength of which is in a certain range, can offer a cleaning effect which cannot be achieved by the so-called wet cleansing. Moreover, acyl group (COH), hydroxyl group (OH), carboxyl group (COOH), etc., are generated, by active oxygen, on the surface of the substance being irradiated with the UV rays. Thus, as the abovementioned long and narrow portions of the surface G, that is, the surface of the recording element, which has the nozzle openings, is irradiated with the UV rays, they increase in the amount of the oxygen on them, being thereby improved in terms of the efficiency with which they chemically bond with the adhesive layer of the protective tape.

Figure 6:
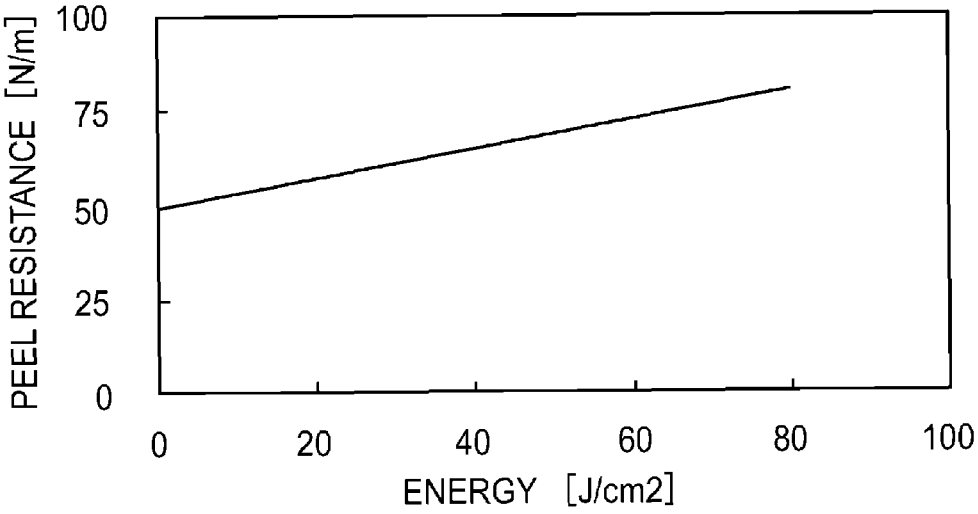
FIG. 6 is a graph showing the relationship between the energy density of the UV light, with which the surface of the recording element, which has the nozzle openings, is irradiated, and the amount of the peel resistance of the protective tape, that is, the amount of force necessary to peel the protective tape from the surface irradiated with the UV light.
Figure 7:
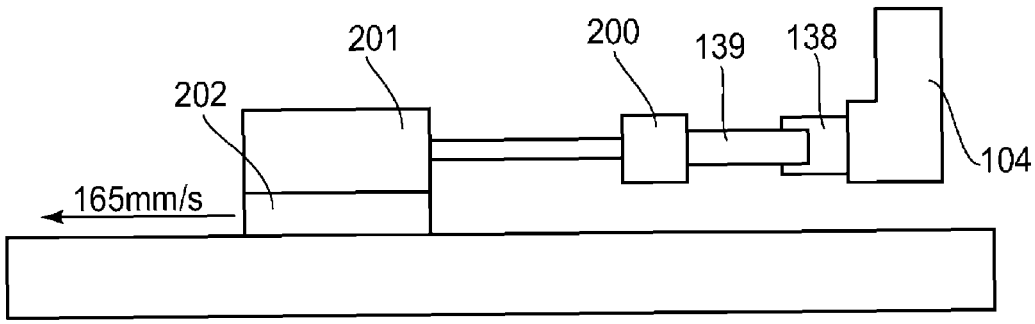
FIG. 7 is a schematic drawing of the apparatus for measuring the amount of force necessary to peel the protective tape away from the ink jet recording cartridge (recording element).

Shown in FIG. 6 is the relationship between the peel resistance of the protective tape 138 relative to the recording element 133, and the energy density of the UV light with which the above-mentioned areas of the surface G was irradiated. The peel resistance was measured with the use of a measuring apparatus such as the one shown in FIG. 7. The protective tape 138 was pasted to a sample, and the tab portion 139 of the protective tape 138 was gripped by a clamp 200, which was connected to a push/pull gauge 201 which was attached to a stage 202. Then, the stage 202 was moved in the direction to peel the protective tape 138 away from the sample, while measuring with the push/pull gauge 201 the amount (peel resistance) of force necessary to peel the protective tape 138. The stage 202 was moved at 165 mm/sec.

At this point in time, the measurement of the peel resistance will be described in more detail. The peel resistance, in FIG. 6, of the protective tape 138 relative to the area of the surface G, which has not been changed in surface properties, means the amount of force (measured by abovementioned testing device) which was necessary to peel away the protective tape 138 immediately after it was pasted across the entirety of the area of the sample (areas of surface G, or the surface of recording head, which has not been changed in surface properties). The peel resistance, in FIG. 6, of the protective tape 138 relative to the surface of the sample, which has been changed in surface properties, means the amount of force (measured by abovementioned testing device) which was necessary to peel away the protective tape 138 immediately after the protective tape 138 was pasted across the entirety of the area of the sample (areas of surface G, or the surface of recording head, which has been changed in surface properties). In other words, it does not exactly mean the amount of force necessary to peel the protective tape 138 from the areas of the recording element 133, which have been changed in surface properties. However, the peel resistance between the protective tape 138 and the areas which had been changed in surface properties represents the major portion of the measured peel resistance. Incidentally, the peel resistance of the protective tape, relative to the processed areas of the surface of the recording element which has the nozzle openings, and the peel resistance of the protective tape relative to the unprocessed areas of the surface of the recording element which has the nozzle openings, can be measured in the following manner. The protective tape is to be pasted across the entirety of the surface of the recording element, which has the nozzle openings. Then, before the protective tape is peeled, it is to be sliced so that a strip of protective tape is formed in the portion of the protective tape on the surface which has been changed in properties, and another strip of protective tape, which is the same in size, is formed in the portion of the protective tape on the surface which has not been changed in properties. Then, the two strips of protective tape are to be individually measured in peel resistance with the use of the abovementioned peel resistance measuring device.

The peel resistance is affected by the choice of the substance used as the material for the substrate layer of the protective tape, and the choice of the adhesive used to form the adhesive layer. Therefore, it is important to the present invention that the peel resistance of the protective tape relative to the surface of the recording element, which has the nozzle openings, is set according to the material for the substrate of the recording element.

Figure 8:
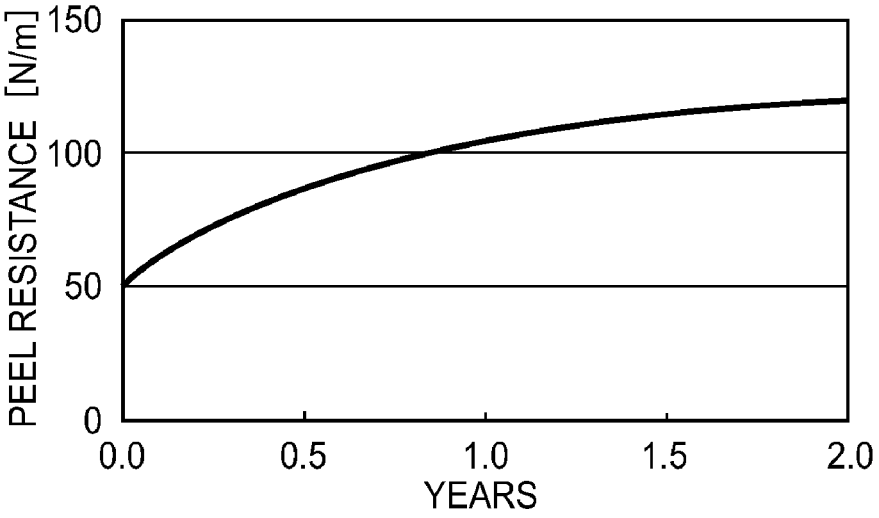
FIG. 8 is a graph showing the relationship between the elapsed time and the amount of force necessary to peel the protective tape away from the ink jet recording cartridge (recording element).

FIG. 6 shows the relationship between the energy density (intensity) of the UV light projected upon the surface of the recording element, which has the nozzle openings, and the peel resistance of the protective tape. It can be read from this graph that the peel resistance is proportional to the intensity of the UV light. Shown in FIG. 8 are the results of the tests carried out periodically to measure the amount of the peel resistance, over the two years following the pasting of the protective tape on the unprocessed surface of the recording head, while keeping the ambient temperature at 25° C. It can be understood from these results that the peel resistance gradually increases with the passing of time. After the two years, the peel resistance of the protective tape pasted on the unprocessed surface of the recording head was 120 N/m, and the peel resistance of the protective tape pasted on the processed surface of the recording head was 150 N/m. In other words, even though the peel resistance changed with the lapse of time, the relationship between the peel resistance of the protective tape on the processed surface, which was relatively high, and the peel resistance of the protective tape on the unprocessed surface, which was relatively low, remained roughly the same. In the case of the abovementioned tests, the peel resistance of the protective tape on the processed surface of the recording head was roughly 1.2 times that on the unprocessed surface of the recording head.

Figure 9:
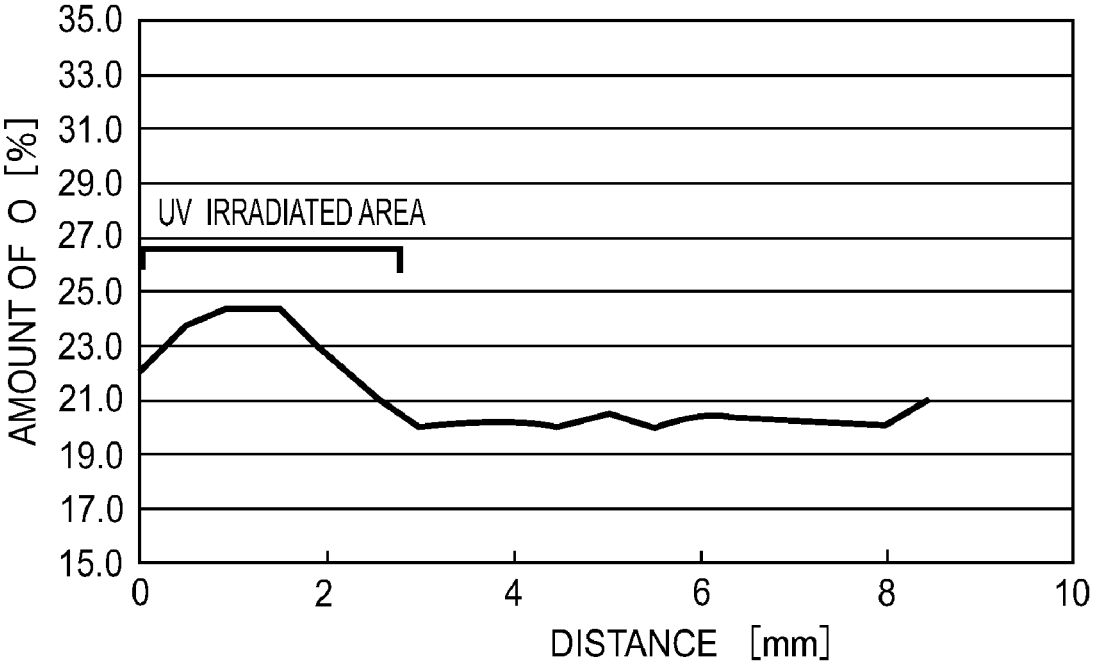
FIG. 9 is a graph showing the relationship between the amount of the oxygen in the surface layer of the recording element, and the distance from the area of the surface of the recording element, which was irradiated with the UV light.

FIG. 9 is a graph showing the relationship between the amount of oxygen in the 7 m thick surface layer of the surface G, that is, the surface of the recording element, the area 11 of which was irradiated with the UV light, and the distance, in terms of the direction indicated by an arrow mark 12, from the edge of the surface of the recording element which has the nozzle opening. The amount of the oxygen was measured with use of the X-Ray Photoelectron Spectroscopy (ESCA: Electron Spectroscopy for Chemical Analysis) In the case of the recording element 133 in this embodiment, the range between 0 mm and 3 mm corresponds to the irradiated area 11. Referring to FIG. 9, the amount of oxygen in this portion was greater than the rest; this portion had increased in the amount of oxygen. That is, this means that the material of the recording head reacted with the active oxygen generated by the UV light, yielding thereby acyl group (COH), hydroxyl group (OH), carboxyl group (COOH), etc., in the surface layer of a part of the surface G. As a result, the area 11 of the surface G was improved in the efficiency with which it chemically bonds with another substance. Although not shown in FIG. 9 to simplify the drawing, as the abovementioned area, which was a part of the surface of the recording element, which had been made to repel ink, was irradiated with UV light, it increased in the amount of oxygen, but, decreased in the amount of other elements, such as F, C, etc.

The present invention resulted from the attention paid to the above-described changes in the amount of the peel resistance of the protective tape relative to the surface of the recording element, which occurred as the surface was changed in the properties by the UV light. Thus, according to the present invention, the adhesiveness (which may be referred to as peel resistance, or amount of force necessary to peel protective tape from recording head) between the surface of the recording element having the nozzle openings, and the protective tape, is increased by increasing the amount of oxygen in the surface layer of the recording element 133, by irradiating the surface with UV light. The portion of the recording element 133, which has been changed in surface properties is likely to be greater in the adhesiveness, relative to the protective tape 138, and lower in ink repellence (having greater affinity for ink) than the portion of the surface of the recording head 133, which has not been changed in surface properties.

In this embodiment, in consideration of the amount of peel resistance which the protective tape needs during its manufacturing process and/or shipment, the energy density of the UV light used for the surface property modification was set to 70 J/cm$^2$. The amount of peel resistance of the protective tape, which can be estimated from FIG. 6, was roughly 80 N/m, and the peel resistance of the protective tape on the property-changed areas of the surface of the recording head, which has the nozzle openings, was 1.6 times the peel resistance of the protective tape on the property-unchanged areas of the surface of the recording head which has the nozzle openings. It is desired that the UV light used for irradiating the aforementioned surface areas of the recording head to change the surface properties is adjusted according to the environment in which the recording head is used.

Incidentally, in consideration of the need for ensuring that the protective tape remains properly adhered to the aforementioned surface of the recording head which has the nozzle openings, and also, that the protective tape can be peeled away without difficulty, the practical ratio of the amount of peel resistance of the protective tape relative to the portion of the surface of the recording head which had been changed in properties, relative to the amount of the peel resistance of the protective tape relative to the portion of the surface of the recording head which had not been changed in properties, is within a range of roughly 1.2-2.0 times. Further, in consideration of the need for ensuring that the recording head is easy to operate, and also, that the recording head is easy to manufacture, the ratio of the amount of peel resistance of the protective tape relative to the portion of the surface of the recording head, which had been changed in properties, relative to the amount of the peel resistance of the protective tape relative to the portion of the surface of the recording head, which had not been changed in properties, is desired to be within a range of roughly 1.2-1.6 times.

In this embodiment, the surface of the recording element, which has the nozzle openings, is irradiated with the UV light so that a space, the dimension of which in terms of the direction parallel to the rows of nozzle openings is L, is provided between each of the two irradiated areas 11 and the corresponding end of each row of nozzle openings, in order to ensure that even if ink collects on the areas 11 because the areas 11 are reduced in ink repellence due to the exposure to the UV light, the ink does not interfere with the nozzle openings. The distance L is to be made as large as possible without causing structural problems to the recording element 133. In this embodiment, the distance L was made to be 0.2 mm in width (L=0.2). Incidentally, the recording element 133 is provided with two rows 142C of nozzle opening, two rows 142M of nozzle openings, and two rows 142Y of nozzle openings, and each row of nozzle openings has 192 nozzle openings. Further, the recording element 133 is provided with a total of 16 dummy nozzle openings, that is, the nozzle openings which are not involved in the jetting of ink. One dummy nozzle opening is located at each end of each row of nozzle openings. The provision of these dummy nozzle openings further improves the recording element 133 in reliability in terms of the jetting of ink; even if ink collects on the above-mentioned areas 11, it does not affect the recording element in ink jetting performance. The protective tape 138 is pasted to the surface of the recording element 133, which has the nozzle openings, so that the protective tape 138 covers at least one of the two areas 11, that is, the areas irradiated with the UV light, more specifically, the irradiated two areas of the lengthwise end portions of the surface of the recording element 133, which has the nozzle openings.

In this embodiment, acrylic adhesive was used as the material for the adhesive layer of the protective tape 138. However, the material for the adhesive layer may be silicone adhesive, or adhesive of the hot-melt type, as long as the material is adhesive enough to keep the protective tape 138 adhered to the recording element 133, without being adhesive enough to destroy the adjacencies of the nozzle openings of the recording element 133 when the protective tape 138 is peeled away from the recording element 133. Obviously, various substances can be used as the materials for the substrate layer of the protective tape 138 as long as they can achieve the objective of not destroying the nozzle opening portions of the recording element 133 when the protective tape 138 is peeled.

In this embodiment, the distance L between the lengthwise end of each row of nozzle openings and the corresponding area 11 was set to 0.2 mm. However, it does not need to be limited to 0.2 mm; it may be varied according to the specification of the recording element 133.

As described above, the adhesiveness of the protective tape 138 relative to the preselected area(s) of the recording element (which in this embodiment is the lengthwise end(s) of the surface of recording element 133, which has nozzle openings), can be changed (improved) by irradiating the preselected area(s) with the UV light, the energy density of which is in the preset range. In other words, the area(s) of the surface of the recording element, across which the protective tape 138 is to be pasted, can be changed in surface properties by the irradiation of the area(s) with the UV light, in order to make the adhesiveness between the abovementioned area(s) and protective tape 138 sufficient (that is, without being strong enough to damage the nozzle opening portions of the recording element when the protective tape is peeled) to prevent the protective tape from peeling away from the area(s) while the ink jet recording cartridge is manufactured or shipped, and yet, weak enough to allow the protective tape to be easily peeled away when the protective tape needs to be peeled away.

Embodiment 2

Figure 10:
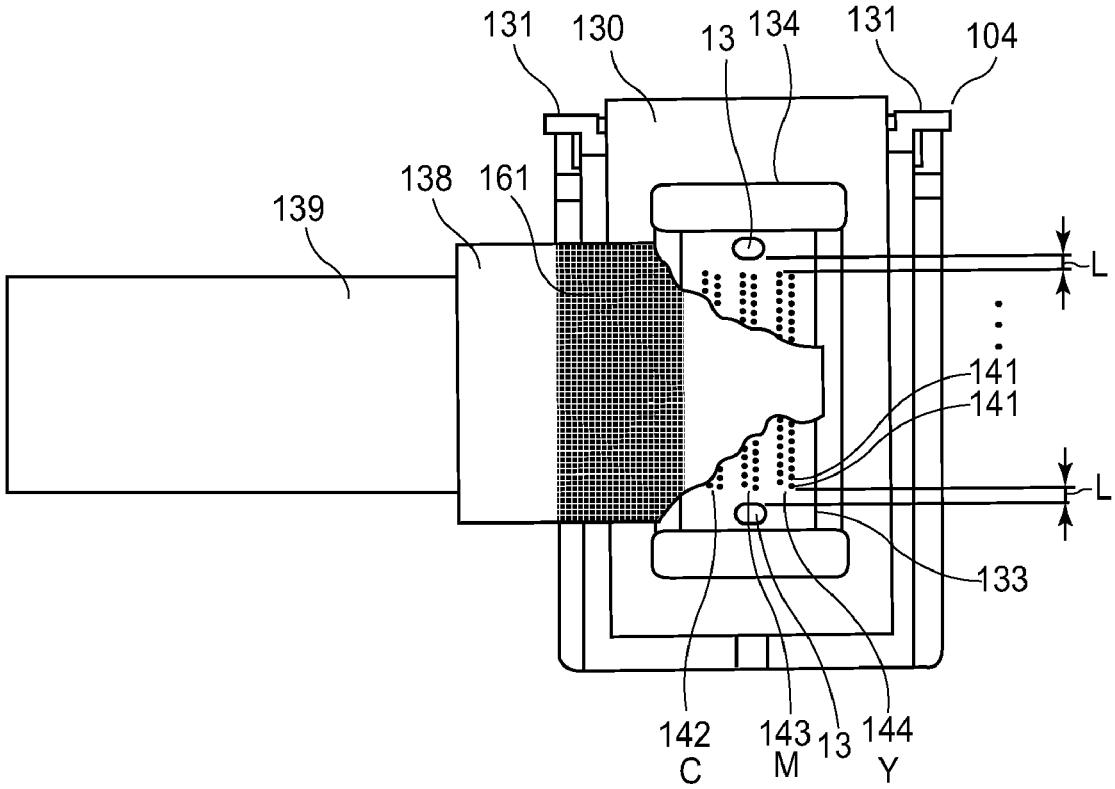
FIG. 10 is a plan view of the ink jet recording cartridge in the second embodiment of the present invention.

FIG. 10 is a plan view of the ink jet recording cartridge in the second embodiment of the present invention. This ink jet recording cartridge 138 is also provided with the protective tape 138 which was pasted to the recording element as it was in the first embodiment. This embodiment (including devices used for testing of ink jet recording cartridge) is the same as the first embodiment, except for the area(s) of the surface of the recording element, which is irradiated with UV light.

Designated by a referential number 13 is each of the areas of the recording element which are irradiated with UV light. The area 13 is smaller than the area 11, that is, the surface area of the recording element, which was irradiated with the UV light in the first embodiment. The areas 13 also belong to the surface of the recording element, which has the nozzle openings. Each of the areas 13 constitutes a part of the corresponding lengthwise end of the surface having the nozzle openings, as does each of the areas 11 in the first embodiment. This embodiment is different from the first embodiment in that the areas 13, which are equivalent to the areas 11 in the first embodiment, are substantially smaller in dimension in terms of the direction perpendicular to the rows of nozzle openings than the areas 11; they extend only in the adjacencies of the ends of the rows 143M of nozzle openings. The distance L from the lengthwise end of the row 143M of nozzle openings to the corresponding area 13 is the same as that in the first embodiment, which is 0.2 mm (L=2.0). The areas 13 were irradiated with the UV light, which was 70 J/cm$^2$ in energy density, and the protective tape 138 was pasted to the surface of the recording element 133, which has the nozzle openings, in such a manner that at least one of the areas 13 is covered with the protective tape 138.

The protective tape 138 in this embodiment is provided with an adhesive layer which is more adhesive than the adhesive layer of the protective tape 138 in the first embodiment; the peel resistance of the protective tape 138, in this embodiment, pasted on the areas 13 (which had been changed in properties) of the recording element 133 was 100 N/m. Although the areas 13 in this embodiment were created by irradiating the surface of the recording element 133 with the UV light in a manner of spot lighting the specific surface areas of the recording element 133, it was satisfactory in terms of the peel resistance of the protective tape 138 relative to the areas 13 in that the protective tape 138 did not peel away from the areas 13, and also, that the problem that ink is allowed to leak by the local separation of the protective tape 138 from the areas 13 did not occur. In other words, the ink jet recording head in this embodiment was capable of withstanding the rigor of ordinary usage.

The ink jet recording cartridge shown in FIG. 10, which is smaller in the surface area which had been changed in properties, than the ink jet recording head shown in FIG. 5, has the following advantages over the ink jet recording cartridge shown in FIG. 5.

That is, the former is smaller than the latter in the size of the area(s) which needs to be processed to be changed in properties, and is therefore easier to process. Further, the former is processed only across the small center portion of the surface of the recording element, which has the nozzle openings, in terms of the direction perpendicular to the rows of nozzle openings. Therefore, the amount of force which must be used to peel the protective tape 138 away from the recording element 138 is relatively small at the beginning of the peeling. As the line of separation between the protective tape 138 and recording element reaches the areas 13, the peeling resistance temporarily increases and remains at that level while the protective tape 138 is peeled away from the areas 13. Then, as the line of separation moves past the areas 13, the peeling resistance decreases again. In other words, the protective tape 138 on the former easily peels at the beginning of the peeling operation, slightly increases in the resistance as it is further peeled, and then, comes off all at once. Thus, in the case of the ink jet recording cartridge in this embodiment, it does not occur that ink is unintentionally forced out of the nozzles by a user. Further, the areas 13, which had been changed in surface properties, are greater in the affinity for ink, being therefore easier for ink to adhere to when the ink jet recording cartridge is mounted in the recording apparatus. However, the areas 13, that is, the portion of the surface of the recording element in this embodiment, which had been changed in properties, is smaller in size, and therefore, ink is less likely to collect on the areas 13 than it is on the areas 11, that is, the portion of the surface of the recording element in the first embodiment which had been changed in properties.

Next, the method for changing the areas, shown in FIG. 10, in surface properties will be described. This method is characterized in that the UV light, which has been used to solidly attach the recording element 133 to the electrical wiring board 130, is utilized as the UV light to be irradiated upon the areas shown in FIG. 10, to improve the areas in terms of the peel resistance of the protective tape 138 relative to the areas.

Figure 11:
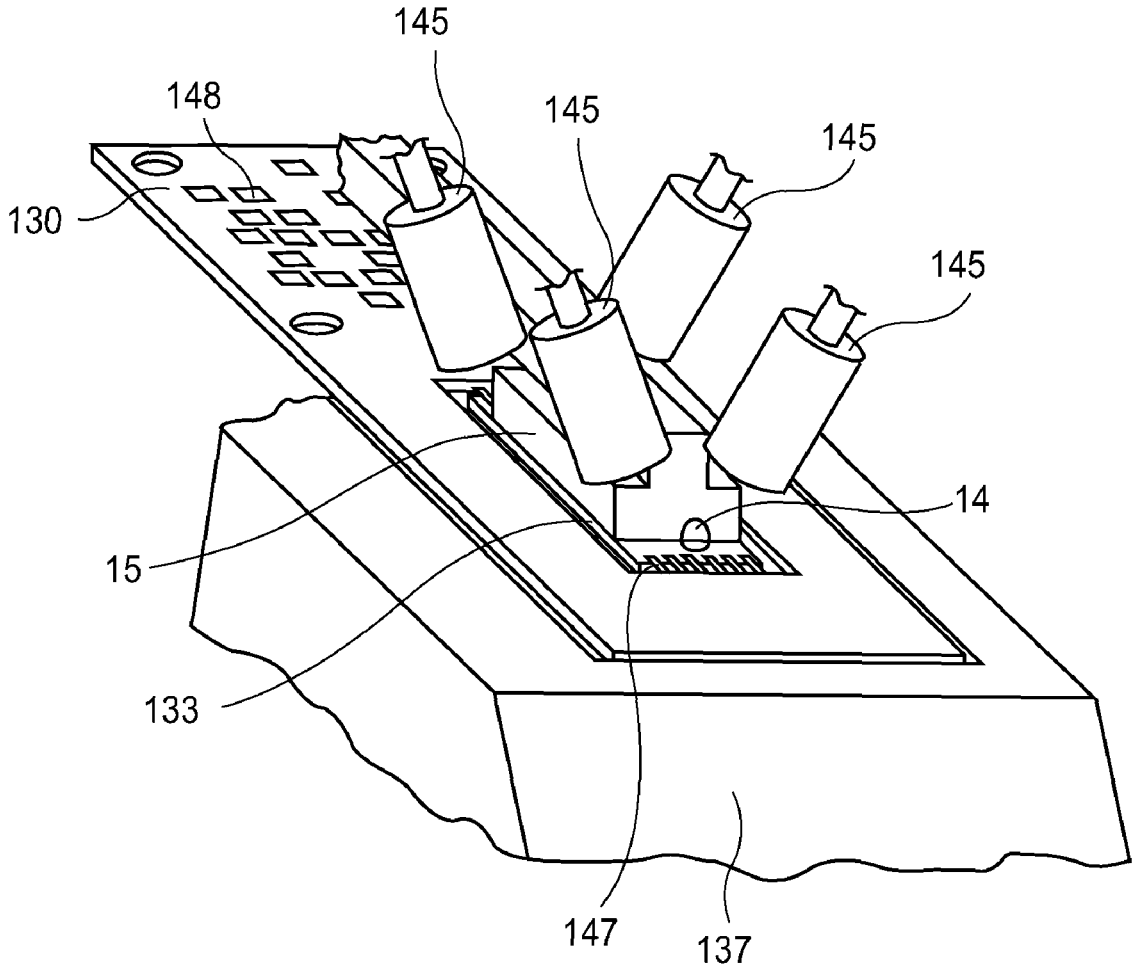
FIG. 11 is a plan view of the ink jet recording cartridge in the third embodiment of the present invention.

FIG. 11 is a schematic perspective view of the bottom portion of the Cl cartridge, which shows best the method for manufacturing the ink jet recording cartridge in this embodiment. The unit F is held to the ink container 137 by a retention mechanism 15, and is precisely positioned relative to the ink container 137, with the use of the portions of the ink container 137, with which the ink container 137 is provided. Before the unit F is attached to the ink container 137, the portion of the ink container 137, to which the unit F is to be attached, is coated with adhesive, which is to be cured by ultraviolet rays. The recording element 133 is irradiated for a preset length of time with the UV light transmitted through optical fibers 145, and then, is solidly attached to the ink container 137. Then, the electrical wiring board 130 is solidly attached to the ink container 137. That is, the electrical wiring board 130 is placed on the ink container 137, and heat is applied to the combination of the electrical wiring board 130 and ink container 137 while applying pressure upon the electrical wiring board 130 with the use of a flat device called a horn.

In order to improve the areas 14 in terms of the peel resistance of the protective tape relative to the areas 14, the areas 14 are irradiated with the UV light at the same time that the above-mentioned adhesive for solidly attaching the recording element 133 is irradiated with the UV light. During this step, the lateral surfaces of the retention mechanism 15 are also irradiated with the UV light. In other words, the retention mechanism 15 blocks the UV light, thereby preventing the nozzle opening portions of the recording element from being irradiated with the UV light.

As described above, in this embodiment, the ink jet recording cartridge is improved in terms of the adhesion of the protective tape to the areas 14 of the recording element by irradiating the areas 14 with the UV light at the same time that the above-mentioned adhesive for solidly attaching the recording element 133 is irradiated with the UV light. Thus, it is possible to improve the ink jet recording cartridge, in terms of the adhesion of the protective tape to the recording element 133, without need for a manufacturing step dedicated to the irradiation of the recording element 133 with the UV light.

Obviously, also in the first and second embodiments, the surface of the recording head, which has the nozzle openings, may be irradiated with the UV light in the step in which the recording element 133 is temporarily fastened to the ink container 137.

Embodiment 3

Figure 12:
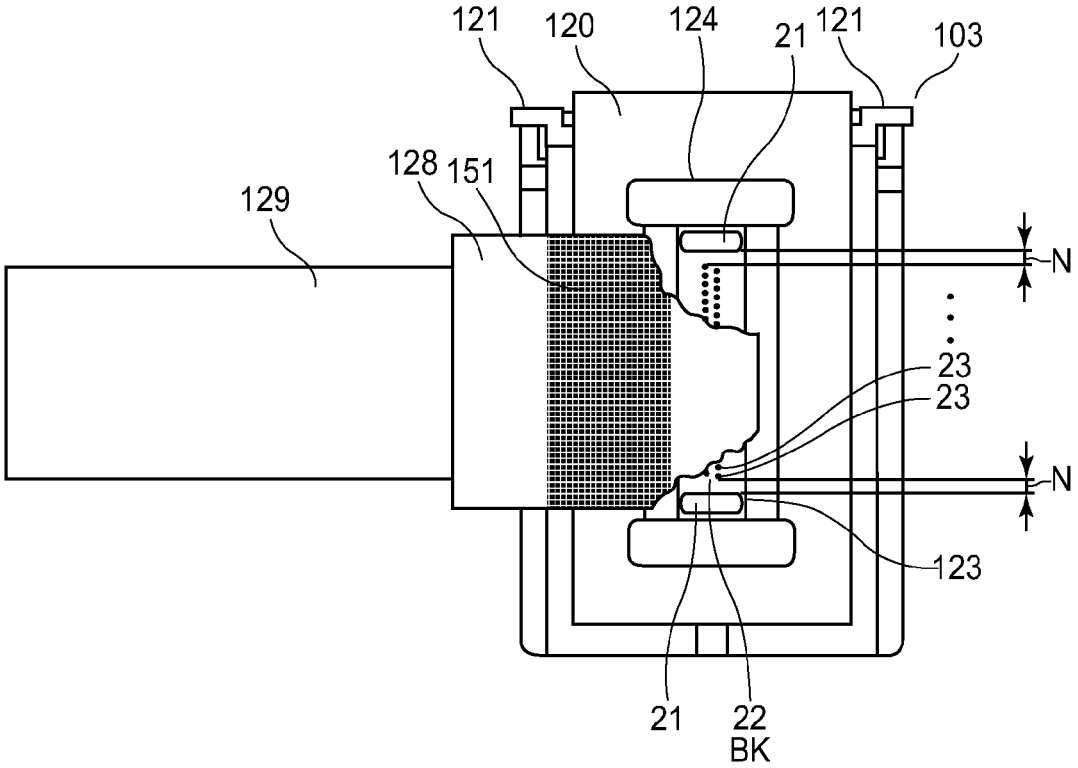
FIG. 12 is a plan view of the ink jet recording cartridge in the fourth embodiment of the present invention.

FIG. 12 is a schematic plan view of the ink jet recording cartridge in the third embodiment of the present invention. The ink jet recording cartridge in this embodiment is provided with the protective tape 128, which is pasted to the recording element 123, as the protective tape 128 was in the first and second embodiments. The ink jet recording cartridge in this embodiment is the Bk cartridge 103. This embodiment (including devices such as those used for testing of ink jet recording cartridge) is the same as the first and second embodiments, except for the surface areas of the recording element which are irradiated with the UV light. That is, in this embodiment, the surface of the recording element, which has the nozzle openings, is irradiated with the UV light so that only the areas of the surface which are most suitable for achieving the objects of the present invention are irradiated with the UV light.

Designated by a referential number 21 is the surface area of the recording element 123, which is irradiated with the UV light in this embodiment. The areas 21 are located at the lengthwise ends of the recording element 123. There is provided a space, the dimension of which in terms of the direction parallel to the rows of nozzle openings is N, between the area 21 and the closest nozzle openings, that is, the nozzle opening located at the end of the row of nozzle openings. Therefore, even if ink collects on the area 21 (because area 21 is reduced in ink repellence by being irradiated with UV light), the ink does not interfere with the nozzle openings. In this embodiment, the distance N was set to be as large as possible without causing structural problems to the recording element 123. In this embodiment, it was set to 0.42 mm (N=0.42). The areas 21 were irradiated with the UV light, which was 70 J/cm$^2$ in energy density, as was the UV light used in other embodiments, and the protective tape 128 was pasted to the surface of the recording element 123, which has the nozzle openings, in such a manner that at least one of the areas 21 is covered with the protective tape 128.

Incidentally, the difference in value between the distance N from the distance L (=0.2 mm), which is the distance between the area 11 and the corresponding end of each row of nozzle openings in the first embodiment, and the distance L in the second embodiment comes from the difference in structure between the recording element for the CL cartridge and that for the Bk cartridge. That is, from the standpoint of structure, the Bk cartridge is more likely to allow ink to seep across the aforementioned space between the area which was irradiated with the UV light and the end of each row of nozzle openings than the CL cartridge. Therefore, the distance N was made greater than the distance L (L<N).

As the specific areas of the lengthwise end portions of the surface of the recording element 123 to which the protective tape 128 was to be pasted were irradiated with the UV light as described above, the surface of these areas, which were ink-repellent, were improved in terms of the fastness of the adhesion of the protective tape 128 to these areas. As a result, as the protective tape 128 was pasted to the recording element 123, the fastness of the adhesion between the protective tape 128 and the recording element 123 became sufficient (that is, without being strong enough to damage the nozzle opening portions of the recording element when the protective tape is peeled) to prevent the protective tape from peeling away from the ink jet recording cartridge while the ink jet recording cartridge was manufactured or shipped, and yet, weak enough to allow the protective tape to be easily peeled away when the protective tape needed to be peeled away.

Embodiment 4

Figure 13:
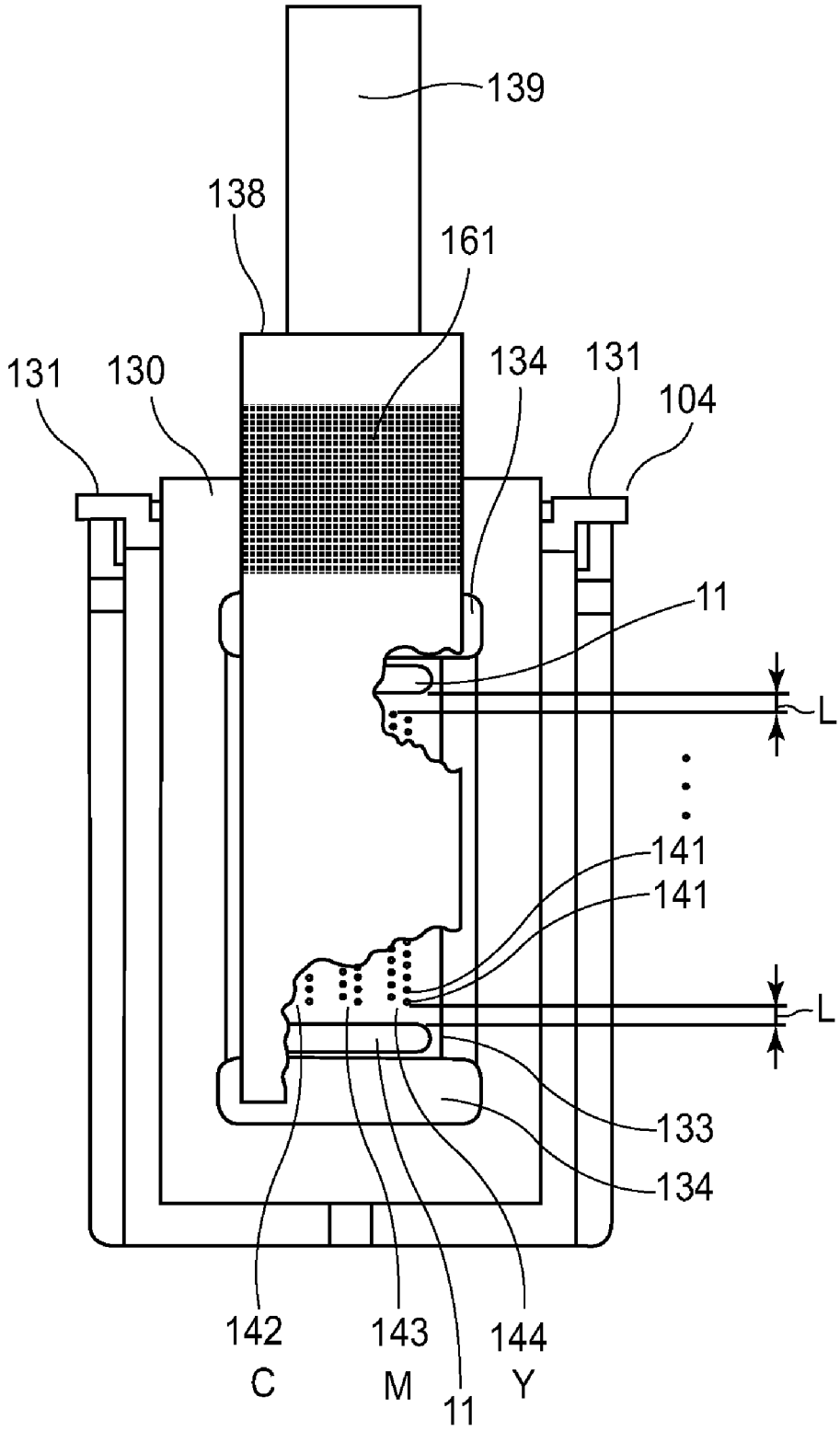
FIG. 13 is a plan view of the ink jet recording cartridge in the fifth embodiment of the present invention.

FIG. 13 is a drawing of the ink jet recording cartridge in the fourth embodiment of the present invention. The recording element 133 is covered with the protective tape 138 which was pasted thereto, as it was in the first, second, and third embodiments. The ink jet recording cartridge in this embodiment is the Cl cartridge. This embodiment (including devices to test this cartridge) is roughly the same as the first embodiment, except for the placement of the protective tape 138; this embodiment is characterized in the placement of the protective tape 138. That is, in the first embodiment, the protective tape 138 was pasted to the recording element so that the protective tape 138 did not involve the sealing agent 134 for the electrical junction. In this embodiment, however, the protective tape 138 is pasted to the recording element so that the protective tape 138 covers the sealing agent 134 in addition to the recording element. In terms of the direction perpendicular to the surface of the recording element, to which the protective tape 138 is pasted, the sealing agent 134 is slightly taller than this surface of the recording element. Thus, if the protective tape 138 is pasted to the ink jet recording cartridge in the manner in which it is pasted in this embodiment, that is, in a manner to cover the sealing agent as well as the recording element surface, with the use of the method in accordance with the prior art, the protective tape 138 does not hold, because the resiliency of the substrate layer of the protective tape 138 causes the protective tape 138 to separate from the recording element surface. However, the present invention made it possible to improve the ink jet recording cartridge in terms of the fastness of the adhesion of the protective tape 138 to the surface of the recording element, which has the nozzle openings. Therefore, even if the protective tape 138 is pasted to the ink jet recording cartridge in a manner to cover the sealing agent as well as the recording element, it does not occur that the resiliency of the substrate layer of the protective tape 138 causes the protective tape 138 to peel away from the ink jet recording cartridge; it remains adhered fast to the recording element and therefore, keeps the nozzle openings covered. Also in this embodiment, the adhesion of the protective tape 138 to the recording element was strong enough to prevent the protective tape 138 from peeling away (falling) from the ink jet recording cartridge while the ink jet recording cartridge was manufactured or shipped, and yet, it allowed the protective tape 138 to be easily peeled by a user. Further, it was not strong enough to cause the nozzle opening portions to be damaged when the protective tape 138 was peeled by the user.

Incidentally, in the preferred embodiments described above, ultraviolet rays are used as the means for changing in properties the surface to which the protective tape is to be pasted, in order to improve the fastness of the adhesion of the protective tape to the surface. However, the means does not need to be limited to ultraviolet rays. That is, means other than ultraviolet rays may be used as long as the surface to which the protective tape is to be pasted, can be changed in properties. For example, the surface may be irradiated with plasma.

The recording element mentioned in the description of the preferred embodiments described above may be made up of a substrate formed of silicon or the like, an electrical circuit board, and a connective portion(s) which connects the substrate and electrical circuit board.

An ink jet recording cartridge to which the present invention is applicable is an integrated combination of an ink jet recording head and an ink container. As the ink in an ink jet recording cartridge of this type is completely consumed, the cartridge is to be replaced by a user. In recent years, from the standpoint of environmental concerns, it has come to be required to study the program for recycling used ink jet recording cartridges of this type.

An ink jet recording cartridge, which is in the form of an integrated combination of an ink jet recording head and an ink container, remains wet with ink for a while, across its surface having the nozzle openings, after it is used. This ink on the surface of the ink jet recording cartridge, which has the nozzle openings, dries up with the elapse of time. Thus, after a certain length of time (several weeks, for example), the surface will be covered with the solidified ink.

Figures 14, 15:
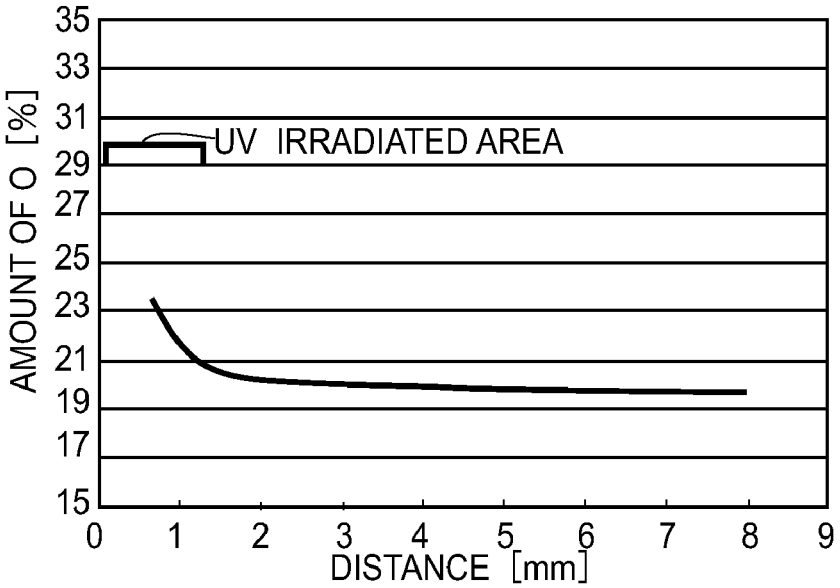
FIG. 14 is a graph showing the relationship between the amount of oxygen in the surface layer of the recording element of the ink jet recording cartridge, which was measured after the ink jet recording apparatus ran out of ink, and the distance from the area of the surface of the recording element, which was irradiated with the UV light.
FIG. 15 is a table showing the relationship among the various conditions of the ink jet recording cartridge, amount of force necessary to peel the protective tape away from the ink jet recording cartridge, and effectiveness of the protective tape.

Recording heads which were in the above described condition were cleaned, and the amount of oxygen on the surface of each recording head, which had the nozzle openings, was measured. FIG. 14 shows the results of the measurement (after inks in ink jet recording cartridge were used up by printing pattern which was roughly 7.5% in cyan, magenta, and yellow duties, the amount of oxygen in above-mentioned portions of the recording head was measured using the same method as the method used to analyze (results of which are shown in FIG. 9) the amount of oxygen on the surface of the recording head having nozzle openings). As is evident from FIG. 14, it was confirmed that the area which had been changed in surface properties remained greater in the amount of oxygen than the rest (incidentally, the distance between the area irradiated with the UV light and the closest point therefrom at which the amount of oxygen is the same as that of the irradiated area is shorter compared to results shown in FIG. 9, but the area marked as the area irradiated by UV light is equivalent to a distance of 3 mm in FIG. 9). Referring to FIG. 15, the amount of peel resistance remained the same as the amount of peel resistance which the protective tape had immediately after it was pasted. The peel resistance of the protective tape was measured while the surface of the recording element, which had the nozzle openings, was wet with ink (three months after continuous printing), as well as after the ink dried up (three month after continuous printing). When the protective tape was pasted while the recording element was in these conditions, a minute amount of ink which remained in the nozzles, or the like, was drawn out and wetted the surface to which the protective tape was pasted. Thus, the peel resistance was extremely small.

Thus, when recycling ink jet recording cartridges, it is very important to thoroughly clean the surface of the recording element of each cartridge, which has the nozzle openings.

As described above, changing specific surface areas of the recording element of an ink jet recording head, which has the nozzle openings is advantageous in that it can provide a conventional protective tape (protective tape in accordance with the prior art) with a proper amount of peel resistance relative to the surface having the nozzle openings, without modifying the protective tape.

Incidentally, the apparatus used to measure the amount of peel resistance in this embodiment had an error of roughly 10%. Obviously, the peel resistance of a protective tape relative to a given surface is affected in numerical value by the level of the adhesiveness of the protective tape. Yet, the apparatus used to test the ink jet recording cartridges in the preferred embodiments described above can correctly show the relationship that a protective tape is greater in peel resistance when it is pasted to a surface area of an ink jet recording cartridge which had been changed in properties than when it is pasted to a surface area of an ink jet recording cartridge which had not been changed in properties.

INDUSTRIAL APPLICABILITY

The present invention provides an ink jet recording head having ejection outlets which is properly protected, without using special processes and manufacturing equipment to manufacture an ink jet recording head, and without modifying a protective tape in adhesiveness, and its primary object is to provide an ink jet recording head.

While the invention has been described with reference to the structures disclosed herein, it is not confined to the details set forth, and this application is intended to cover such modifications or changes as may come within the purposes of the improvements or the scope of the following claims.

The invention claimed is:

1. An ink jet recording head having an array of ink ejection outlets in an ejection outlet forming surface to which protection tape is adhered in transportation, wherein said ejection outlet forming surface has an outside area which is outside of each of opposite ends of the array with respect to a direction of the array, and the outside area has a peel resistance, provided by surface modification, which resistance is higher than in another portion of said ejection outlet forming surface.

2. An ink jet recording head according to claim 1, wherein the peel resistance of the outside area is 1.2-1.6 times the peel resistance of said other area.

3. An ink jet recording head according to claim 1, wherein the outside area exhibits a relatively higher affinity to ink and said other area exhibits a relatively higher repellence against the ink.

4. An ink jet recording head according to claim 1, wherein said protection tape comprises a base film having one surface with an adhesive layer.

5. A transportation structure of said ink jet recording head as defined in claim 1 and protection tape adhered to said ejection outlet forming surface.

6. An ink jet recording cartridge comprising an ink jet recording head as defined in claim 1 and an ink container accommodating ink to be supplied to said ink jet recording head.

7. An ink jet recording head having an array of ink ejection outlets in an ejection outlet forming surface to which protection tape is adhered in transportation, wherein said ejection outlet forming surface has an outside area which is outside of each of opposite ends of the array with respect to a direction of the array, and the outside area has greater surface oxygen than another portion so that a peel resistance is higher than that in said other portion of said ejection outlet forming surface.

8. An ink jet recording head according to claim 7, wherein the peel resistance of the outside area is 1.2-1.6 times the peel resistance of said other area.

9. An ink jet recording head according to claim 7, wherein the outside area exhibits a relatively higher affinity to ink and said other area exhibits a relatively higher repellence against the ink.

10. An ink jet recording head according to claim 7, wherein said protection tape comprises a base film having one surface with an adhesive layer.

* * * * *